United States Patent [19]

Lycan

[11] Patent Number: 4,737,603

[45] Date of Patent: Apr. 12, 1988

[54] ISOLATION SWITCH

[75] Inventor: Jennings Lycan, Huntington, W. Va.

[73] Assignee: Service Machine Company, Huntington, W. Va.

[21] Appl. No.: 71,338

[22] Filed: Jul. 9, 1987

[51] Int. Cl.[4] ..... H01H 3/00; H01H 15/20

[52] U.S. Cl. ..... 200/18; 200/16 E; 200/34; 200/163

[58] Field of Search ..... 200/1 V, 11 TC, 16 A, 200/16 B, 16 E, 162, 163, 293, 302.1, 5 R, 17 R, 18

[56] References Cited

U.S. PATENT DOCUMENTS

| | | | |
|---|---|---|---|
| 3,177,305 | 4/1965 | Lehman | 200/6 B |
| 3,222,485 | 12/1965 | Hardesty et al. | 200/16 E X |
| 3,346,710 | 10/1967 | Weston et al. | 200/163 X |
| 3,389,237 | 6/1968 | Wright et al. | 200/144 R |
| 3,414,691 | 12/1968 | Smith | 200/16 A |
| 3,639,704 | 2/1972 | Alinder | 200/163 X |
| 4,074,094 | 2/1978 | Lubbe | 200/163 X |
| 4,339,635 | 7/1982 | Zwillich et al. | 200/48 R |
| 4,563,549 | 1/1986 | Lycan | 200/16 E X |
| 4,639,558 | 1/1987 | Lycan | 200/16 E X |

*Primary Examiner*—J. R. Scott

*Attorney, Agent, or Firm*—Lucas & Brugman McCaleb

[57] ABSTRACT

An isolation switch comprises a mounting plate with a hub adapted to extend forwardly through a wall of an explosion-proof enclosure. A shaft is journaled for axial movement in the hub. First and second stationary contact members are supported on the mounting plate. The first stationary contact member has input and output power contacts, and the second stationary contact member has first and second grounding contacts. Jumpers connect the output power contacts with the second set of grounding contacts. A moveable contact member is moveable by the shaft between a "closed" position connecting the input and output power contacts; and an "open and load-side-grounded" position disconnecting the input and output power contacts and connecting the output power contacts to ground through the grounding contacts. A handle assembly is eccentrically pivoted on the forward end of the shaft, is guided for forward and backward swinging movement, and has cam bosses guided for transverse movement relative to the shaft. The handle assembly has a transverse latch bar connected to a moveable sleeve and has detent tongues engageable with detent flanges on an operator latch guide at the forward end of the hub to hold the handle assembly in closed or open position. In the embodiment shown, the latch bar and detent flanges are asymmetric, that is, the latch bar is eccentrically mounted and the detent flanges are at different axial heights corresponding to the eccentricity of the latch bar.

23 Claims, 6 Drawing Sheets

"OPEN, LOAD-GROUNDED"

"CLOSED"

CIRCUIT BREAKER
ISOLATION SWITCH
O.L.
M
30
32
$L_1$
$L_2$
$L_3$
$LD_1$
$LD_2$
$LD_3$

"OPEN, LOAD-SIDE-GROUNDED"

"CLOSED"
66
68
202a
202b
202c
204a
204b
204c
208
220a
220b
220c
222a
222b
222c
230a
230b
230c
230
248a
248b
248c
250a
250b
250c
266
268
270
274a
274b
274c

ISOLATION SWITCH

BACKGROUND OF THE INVENTION

The invention belongs to the field of electrical switches and particularly to an isolation switch for a system supplying electrical power to a load such as one or more large three-phase induction motors.

An isolation switch is a switch intended for isolating an electric circuit from its source of electric power. It is intended to be operated only after the circuit has been opened by some other means, such as a main switch or circuit breaker, hence it it not designed to interrupt or establish current which would flow under normal operating conditions.

Bulk materials handling conveyors, and mining and loading machines, such as those used in underground coal mines, are examples of high horse-power, high voltage electrically powered equipment for which isolation switches are used to protect electricians servicing the electrical components. Further, electrical power equipment used at or near the working face in a coal mine must be "explosion-proof" to prevent electrical sparks or arcs from igniting any explosive mixture of air and methane or coal dust which may be present. Hence any electrical isolation switch intended for use on coal face equipment must be in an explosion-proof enclosure. Isolation switches previously available have not been easily or inexpensively adaptable for use within explosion-proof enclosures.

Coal mining technology continues to advance rapidly and the power requirements of mining machines continues to increase, probably doubling within the past decade. Motor sizes have tended to increase and utilization voltages have increased as a result. Isolation switches are becoming more and more desirable because of safety concerns, as a means of isolating utilization equipment from the main power supply. Machines are generally located several hundred feed from the main power center, the point at which power is distributed at utilization voltage. Locating the isolation switch within the same enclosure as the motor control gear allows the mine electrician to isolate equipment for repair or diagnosis without having to do so at the remotely located power center. An isolating switch is required by national standards to have means for readily connecting the load-side conductors to ground when disconnected from the source of supply. In addition, it must be possible to verify by visual observation that the switch is actually open and the load side is grounded.

The control equipment enclosure is generally located near the working coal face. Hence any isolation switch intended for use within the control gear enclosure itself must be suitable for installation in an explosion-proof enclosure.

Electrical motors and switches have rotor shafts and handle operating shafts extending from the inside to the outside of an otherwise sealed enclosure. Explosion-proof operation is achieved by journaling the shaft in a bore extending through a hub and providing sufficient axial length and minimum diametrical clearance that any flaming gas resulting from an explosion inside the enclosure will be quenches to a safe temperature by the time it exits through that clearance into the ambient atmosphere.

The clearance between the shaft and bore must not exceed a maximum deemed safe by the Mine Safety and Health Administration (MSHA). Control of that clearance is facilitated by the present invention by making the hub an integral part Of the switch assembly. By contrast, this critical clearance is more difficult to control with conventional isolation switch designs in which the switch is supported inside an enclosure in two planes. That is, it is fastened to one wall having the bore through which the operating shaft extends, and to another wall at right angles to it. Adjustment of the concentricity of the shaft in the bore is made by shifting the attachment mounting on the other wall.

Examples of such conventional isolation switches which when used in explosion-proof enclosures require adjustments in two planes are the Westinghouse Model #3DE1051-2LM Isolator and Kearney Catalog #504012-1 Isolator.

SUMMARY OF THE INVENTION

Accordingly, it is a general object of the present invention to provide a high capacity isolation switch for use with a three-phase power source which is permissible for use in hazardous atmospheres, and which is simple, compact, and easily and effectively fitted for use in an explosion-proof enclosure.

Another object is to provide an isolation switch of improved compact size and which requires mounting on only one wall of an explosion-proof enclosure.

Another object to to provide an isolation switch in which the clearance and concentricity between the operating shaft and its bore are predetermined in manufacture and not subject to change or adjustment during assembly in an explosion-proof enclosure.

Another object is to provide an isolation switch which includes a mounting plate with an integral hub through which the operating shaft is journaled, with the mounting plate suitably fastened to the wall of an explosion-proof enclosure.

Another object is to provide an isolation switch comprising a reciprocable shaft supporting a moveable contact member for movement between first and second stationary contact members aligned along the axis of the shaft which is moveable to a closed position connecting output load-side terminals to power supply terminals, and moveable to an open, load-side-grounded position in which the load-side terminals are disconnected form the power supply terminals and the load-side terminals are also connected to one another and to ground.

Another object is to provide such an isolation switch in which separate input and output power contacts are supported on one stationary contact member and two sets of grounding contacts are supported on the other stationary contact member and the output power contacts are connected by jumpers to corresponding contacts in one of the sets of grounding contacts.

Another object is to provide such an isolation switch in which contacts and bus conductors are provided on the moveable contact member effective to ground the output power contacts through the jumpers and through both sets of grounding contacts in the open, load-side-grounded position of the operating shaft.

Another object is to provide such an isolation switch in which the moveable contact member has a plurality of twin contact sub-assemblies each having two opposite contact portions connected back-to-back, one contact portion of each being engageable with a corresponding contact on one stationary contact member in the closed position, and the opposite contact portion of each being engageable with a corresponding grounding contact on the other stationary member in the open, load-side-grounded position.

Another object is to provide such an isolation switch in which input and output power contacts on the first stationary contact member are engageable with corresponding contacts on the moveable contact member and bus conductors on the moveable contact member interconnect corresponding ones of the input and output power contacts in the closed position.

Another object is to provide such an isolation switch in which two sets of grounding contactors on the second stationary contact member are engageable with corresponding contacts on the moveable contact member, and bus conductors on the moveable contact member interconnect corresponding ones of the contacts in the two sets of grounding contacts in the open, load-side-grounded position.

Another object is provide such an isolation switch in which the stationary power contact member, stationary grounding contact member, and a moveable contact member therebetween are made of insulating material, each contact member has six equally circumferentially spaced contacts thereon, each group of six contacts comprises a first and second set of three contacts, corresponding contacts in the second sets on the moveable and grounding contact members being interconnected by jumpers, the contacts on the moveable member being double-headed and engageable alternately with the corresponding contacts on the stationary power and grounding contact members, and bus conductors connect corresponding contacts in the first and second sets of contacts on the moveable contact member.

Another object is to provide such an isolation switch in which at least one auxiliary control switch is operable in response to movement of the moveable contact member to coordinate the operation of related or remote apparatus with operation of the isolation switch.

Another object is to provide such an isolation switch in which an operator latch guide is secured to the hub externally of the enclosure and has flat, parallel guide surfaces engaged with a bifurcated cam and lever member on a handle assembly to guide it for swinging movement about a pivotal connection with the shaft, and a pair of cam bosses on a cam and lever member are guided in transverse slots in a pair of operator guide plates to move the shaft forwardly and backwardly in response to swinging movement of the handle assembly.

Another object is to provide such an isolation switch in which the operator latch guide includes a pair of diametrically opposed tongues flanking the shaft and having oppositely outwardly extending detent flanges, and a latch member moveable with a handle sleeve and having a pair of detent teeth at opposite ends of the latch member being alternately engageable with the detent flanges to hold the handle assembly selectively in positions corresponding to closed and opened positions of the switch.

Another object is to provide such an isolation switch in which the operator latch guide is asymmetrically mounted on the handle assembly, being offset from the axis thereof, and the detent flanges are at different axial positions along the shaft corresponding to the offset positions of the detent teeth.

BRIEF DESCRIPTION OF THE DRAWINGS

Other objects and advantages will be apparent from the accompanying drawings in which:

FIG. 12 is an end view of FIG. 11;

DESCRIPTION OF THE PREFERRED EMBODIMENT

Figures 19, 20, 21:
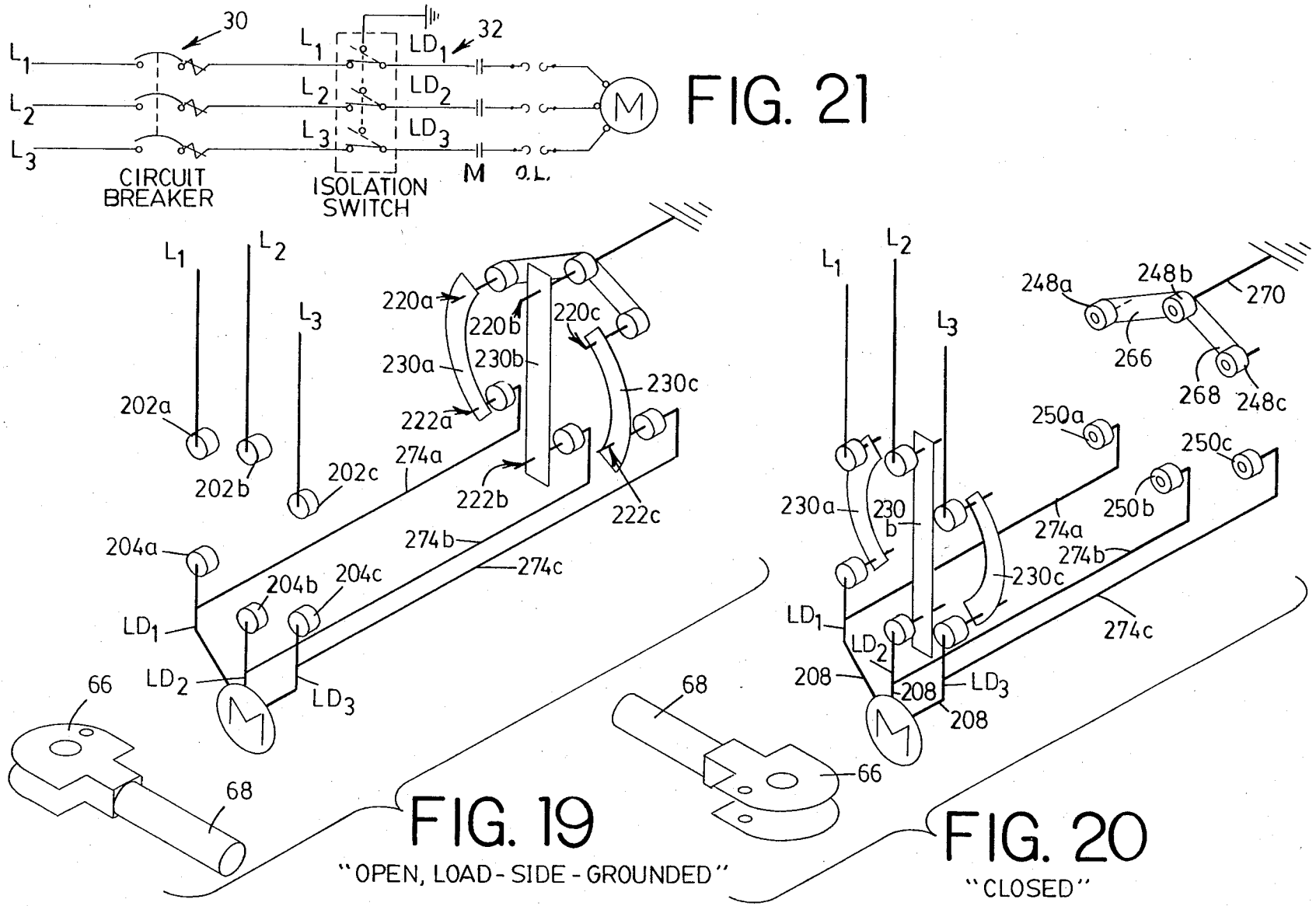
FIG. 19 is a schematic view of the isolation switch in "open, load-grounded" position.
FIG. 20 is a view similar to FIG. 19 in the "closed" position.
FIG. 21 is a diagrammatic representation of a circuit showing an isolation switch positioned for use in a typical application between a main line circuit breaker and an electrical load represented by a motor M.

Referring first to the diagrammatic representation, FIG. 21 shows an induction motor M energized by three-phase power leads L-1, L-2, and L-3 and controlled by a circuit breaker 30. An isolation switch representative of the present invention is designated 32. In the "closed" position of the isolation switch shown in solid lines, the power leads are connected straight through to the motor. The power at the isolation switch 32 does not depend on any contactor. In the "open, load-side-grounded" position shown in broken lines, the motor load is disconnected from the main power leads and are connected to one another and to ground.

Figures 1, 3:
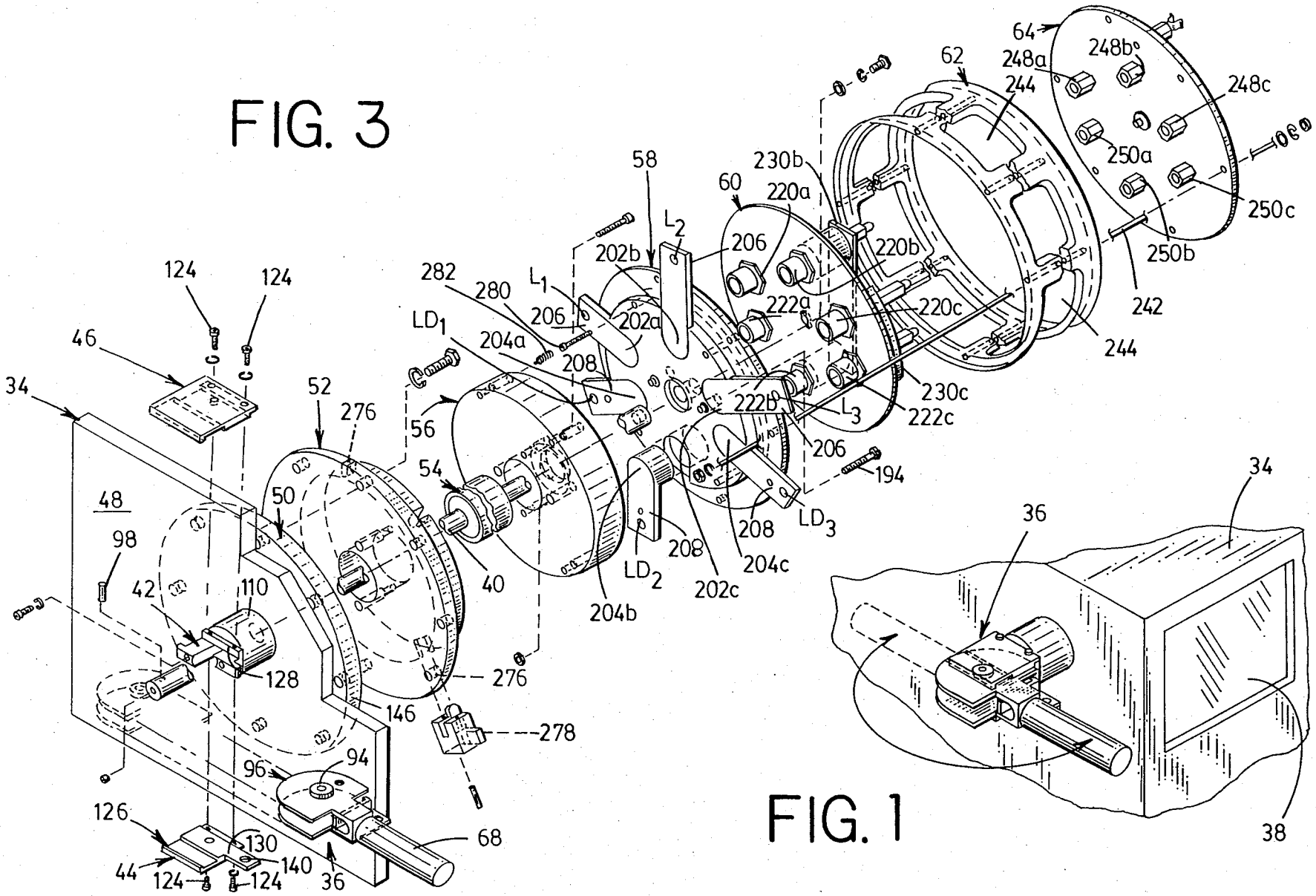
FIG. 1 is a fragmentary perspective view of an explosion-proof enclosure showing the external handle assembly of the present invention.
FIG. 3 is a exploded perspective view of an isolation switch illustrating one form of the present invention.

Referring to FIG. 1, an explosion-proof, sealed enclosure 34 has an external handle assembly 36 and a viewing window 38. The handle assembly is swingable in a horizontal plane from a right-hand, solid line, position to a left-hand, broken line, position.

Figure 5:
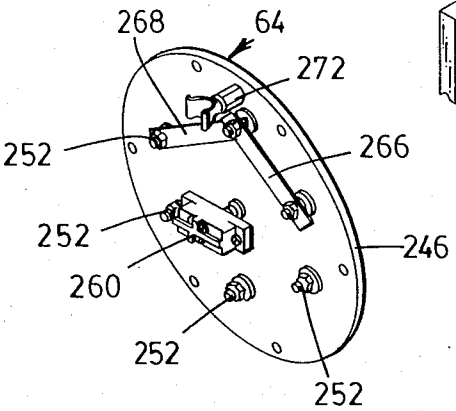
FIGS. 4 and 5 are perspective views of the backsides of two components shown in FIG. 3.
Figure 4:
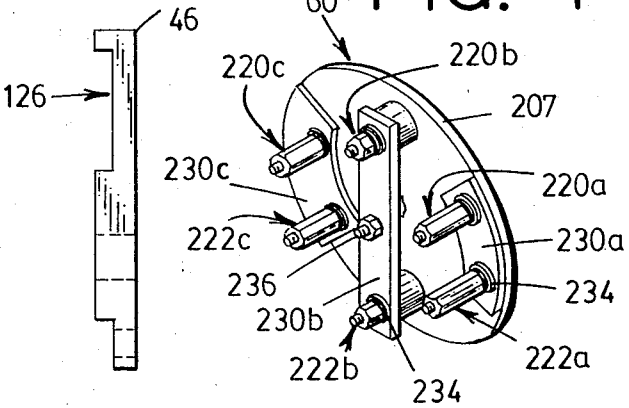
Figure 8:
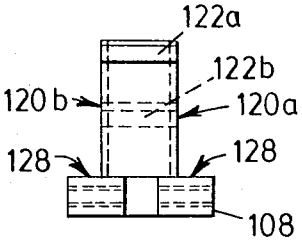
FIG. 8 is a right-hand end view of FIG. 7.
Figure 11:
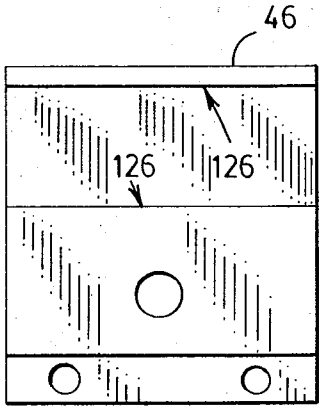
FIG. 11 is an inside view of one of the operator guide plates, showing the transverse guide slot.
Figure 7:
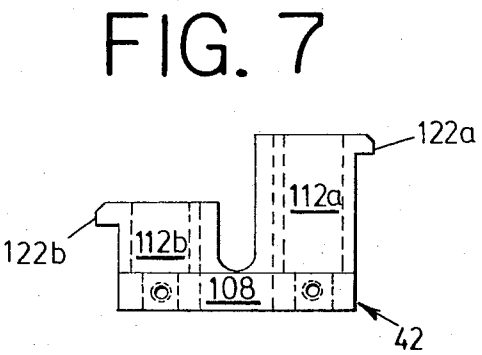
FIG. 7 is a side view of the operator latch guide.
Figure 9:
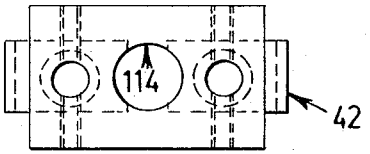
FIG. 9 is a bottom view of FIG. 7.
Figure 10:
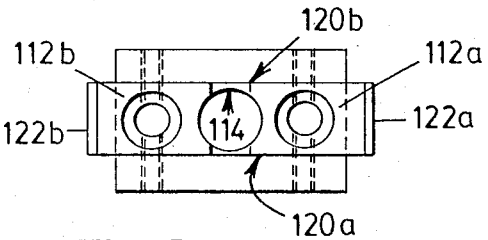
FIG. 10 is a top view of FIG. 7.

The major components of the isolation switch are best shown in FIGS. 3, 4, and 5. From left to right in FIG. 3, they include:

the handle assembly 36;

an operating shaft 40;
an operator latch guide 42;
a pair of guide plates 44 and 46;
a wall 48 of the enclosure 34;
a mounting plate assembly 50;
a stationary insulator base 52;
a dash-pot assembly 54;
a stationary insulator spacer 56;
a first stationary, power contact member 58;
a moveable contact member 60;
an apertured insulator cage or drum 62; and
a secondary stationary, grounding contact member 64.

Figure 13:
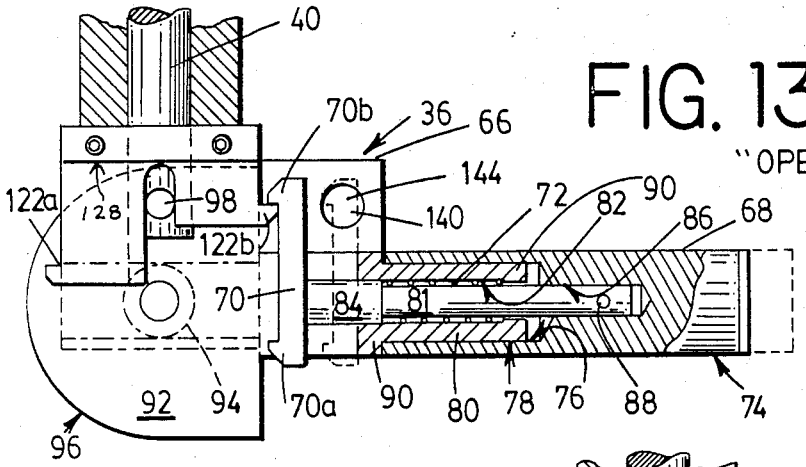
FIG. 13 is a fragmentary view of the handle assembly in the "open, load-grounded" position.
Figure 14:
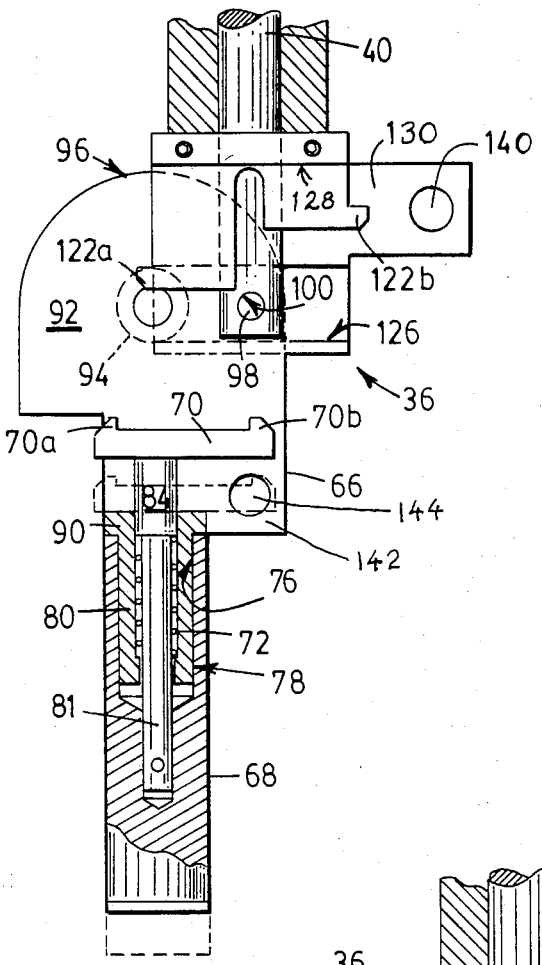
FIG. 14 is a view similar to FIG. 13 showing the handle assembly in intermediate position.
Figure 15:
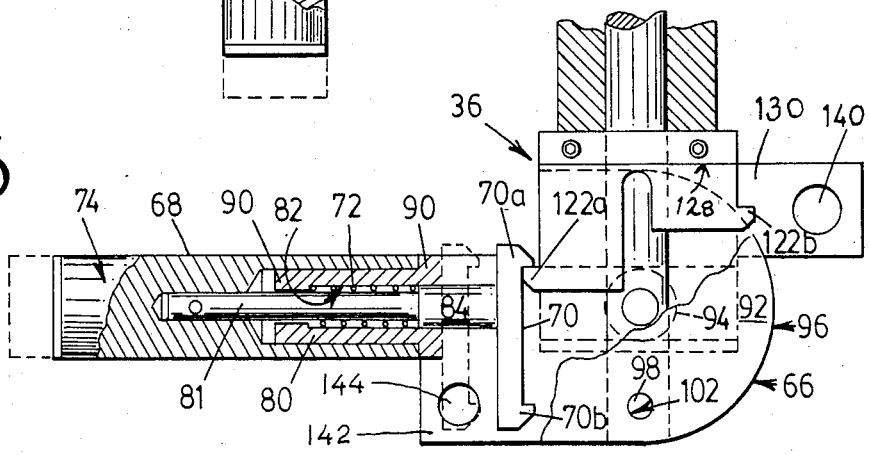
FIG. 15 is a view similar to FIG. 13 showing the handle assembly in "closed" position.

Referring to FIGS. 13, 14, and 15, the handle assembly 36 comprises a bifurcated cam and lever member 66, a handle sleeve 68, a latch bar 70, and a compression spring 72. The handle sleeve 68 has a knurled outside surface 74 and is slidably mounted on cam and lever member 66 by a longitudinally slidable connection between bore 76 and a cylindrical surface 78 on extension 80. The latter has an axial bore 82 slidably engaging a cylindric enlargement 84 on the plunger which is secured in a bore 86 in the handle sleeve by a rivet or roll pin 88. The spring 72 is located in bore 82 surrounding the plunger and is compressibly interposed between the enlargement 84 and shoulder 90, thereby urging the handle sleeve and plunger toward an inward, locked position abutting shoulder 90 as shown in FIGS. 13, 14, and 15.

The bifurcated cam and lever member 66 has a pair of flat, curved-end lever arms 92 with a circular cam boss 94 on the outside surface of each.

Curved edges 96 are provided on the forward ends. These are preferably, but not necessarily, circular arcs struck from the centers of the bosses 94. A pivot pin 98 connects the shaft 40 to off-center positions on the lever arms 92,92. Specifically, the pin 98 is carried in transverse bore 100 in the shaft, and engages each arm 92 in an off-center hole 102, offset laterally from the bosses 94.

The latch bar 70 is transversely secured, asymmetrically, across the inner end of the plunger 81 and is offset from it in the same direction as the pin 98. Detent teeth **70*a*, 70*b*** are provided at opposite ends of the latch bar.

As shown in FIGS. 13, 14, and 15, the latch bar 70 is urged inwardly by spring 72 to the solid line position shown and may be moved outwardly to the broken line position by pulling radially outwardly on the handle sleeve 68.

Referring now to the operator latch guide 42, best shown in FIGS. 6–10, it comprises a unitary member having a base portion 108 transversely positioned across the outer end of the hub portion 110 of the mounting plate assembly 50. A pair of integral, diametrically opposed tongue portions **112*a*,112*b* extend along the shaft 40 in flanking relation therewith. There is a central bore 114 through the base and extending along the inside edges of the tongues. This bore will preferably be the same size as bore 116 within sleeve bushing 118 of the hub 110 and also is in axially slidable guiding relationship with the shaft. The tongues 112*a*,112*b* have flat side surfaces 120*a*,120*b* in guiding relationship with the flat lever arms 92,92 of the cam and lever member 66**.

At the outer ends of the tongues, there are a pair of oppositely outwardly extending detent flanges **112*a*,112*b*. In the particular embodiment shown, tongue 112*a* is longer than tongue 112*b*. The difference in length corresponds to the offset positions of detent teeth 70*a*,70*b* on the latch bar 70**.

The principal functions of the operator latch guide 42 are to guide the handle assembly 36 for horizontal swinging movement, and to provide a means for selectively stably latching the handle assembly in the "open, load-grounded" position shown in FIG. 13, or the "closed" position shown in FIG. 15. The asymmetrical arrangements of the detent flanges **122*a*,122*b* and the detent teeth 70*a*,70*b* are required to provide the maximum holding effect in the latched positions, because of the eccentric location of the pin 198 between the lever arms 92,92. In some special cases, where less than the maximum latching effect would be acceptable, a symmetric arrangement may be used, that is, where the tongues 112*a*,112*b* are the same length and the latch bar 70 is centered on the plunger 81**.

The guide plates 44 and 46 are best shown in FIGS. 3, 6, 11, and 12. These are fastened to opposite sides of the operator latch guide 42 by cap screws 124. Each guide plate has a guide slot 126 on the inside face elongated in a direction transverse to shaft 40. Each guide slot is sized to receive a corresponding circular cam boss 94 to guide it for camming movement to the left and right, transversely to the shaft, when the handle assembly is swung between the FIG. 13 and FIG. 15 positions.

The cam bosses 94, guide slots 126, and arcuate edges 96 optionally may be sized and reproportioned to function in either of two ways:

First, when the switch is moved from the open, load-grounded position of FIG. 13 to the closed position of FIG. 15, the arcuate cam edges 96,96 engage the tracks 128,128 and pull the shaft forwardly as the handle is swung from right to left. During this movement, the bosses 94,94 shift leftwise from center and then rightwise back to center within the guide slots 126,126. During this movement it is not necessary for the bosses to bear against the sides of the slots.

Second, when the switch is moved from the closed position of FIG. 15 to the open, load-grounded position of FIG. 13, the bosses 94,94 bear against the outside edges of the respective slots 126,126 and push the shaft rearwardly as the handle is swung from left to right. During this movement, the bosses again shift leftwise from center, then rightwise back to center within the guide slots. It is not necessary for the cam edges 96,96 to engage the tracks 128,128. As will be seen somewhat exaggerated in FIGS. 13–15, there is slight clearance between the cam edges 96 and the track surfaces 128.

The guide plates 44 and 46 are identical except that plate 44 has an extension 130 with a hole 140. As shown in FIG. 14, one of the lever arms 92 has an extension 142 with a hole 144. When the handle assembly is in the "open, load-grounded" position (FIG. 13), the holes 140,144 are in registration to receive a padlock to positively secure the switch in that position.

Figure 2:
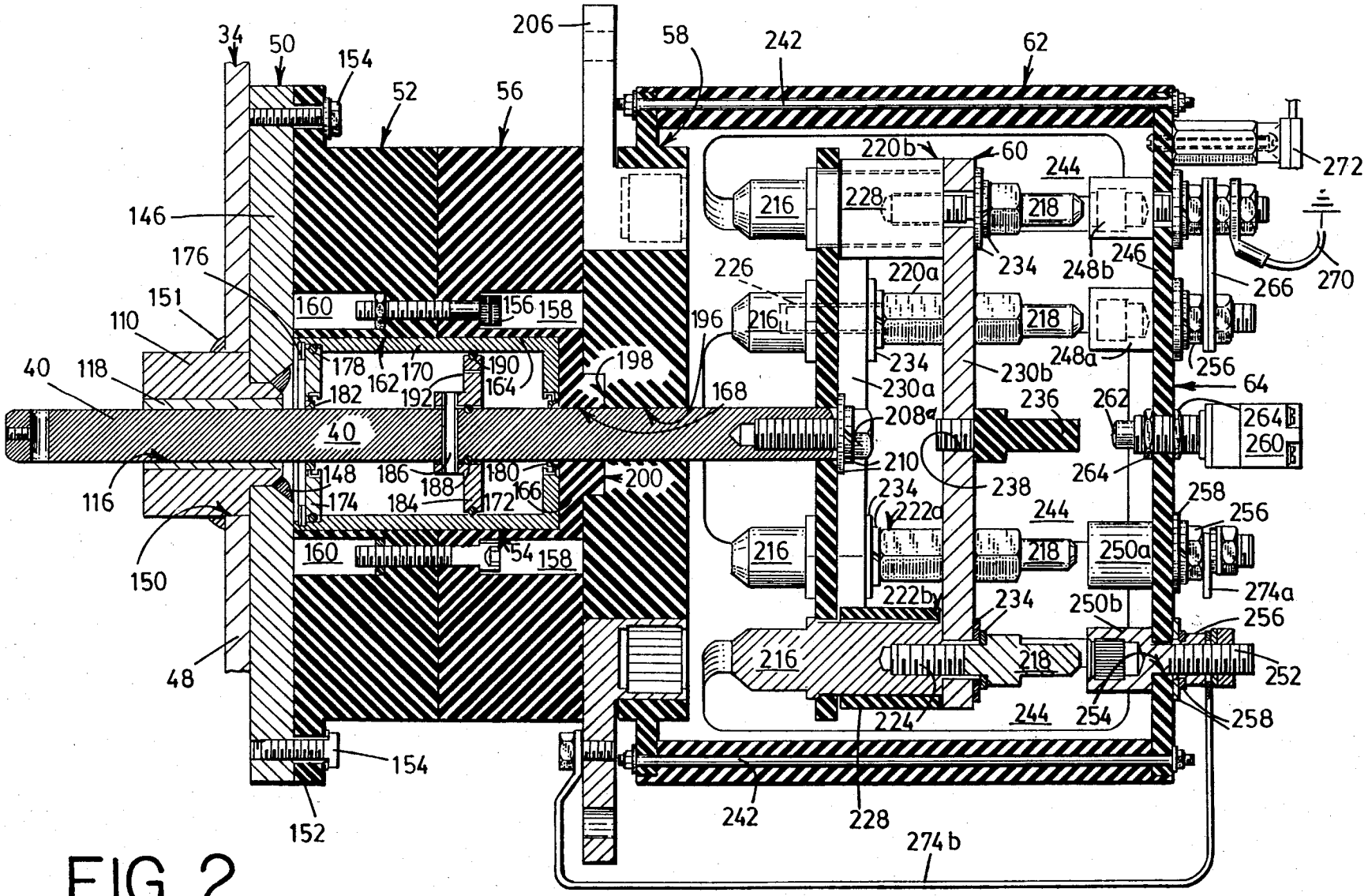
FIG. 2 is a longitudinal cross-sectional view of the isolation switch showing it assembled and in an intermediate position between "closed" and "open, load-grounded" positions.
Figure 6:
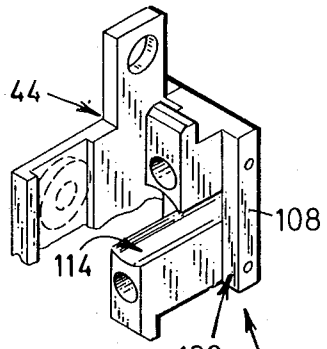
FIG. 6 is a fragmentary perspective view of two external components, namely the operator latch guide and one of the operator guide plates.

The mounting plate assembly 50 comprises a circular plate 146 with the central cylindrical hub 110 secured to it as by welding at 148. The hub 110 extends forwardly through an opening 150 in the wall 48 of the enclosure 34. This is best shown in FIG. 2. The hub is sealed and supported on the front wall 48 by welding as at 151. Alternatively, it may be secured to the wall by bolts (not shown).

The hub 110 is the only exit from the interior of the explosion-proof enclosure 34 to the potentially explosive ambient atmosphere. The clearance between the bore 116 and the shaft 40 should be sufficiently small and provide a long enough path for hot gases resulting from an internal explosion to be effectively quenched to a safe temperature when they exit through the hub.

The stationary insulator base 52 comprises a disk of electrical insulating material such as electric grade Formica. It is circular and has an external flange 152 connected to the mounting plate 50 by cap screws 154.

The stationary insulator spacer 56 also comprises a disk of electrical insulating material. It is fastened to the back side of the insulator base 52 by bolts 156 within recessed bolt holes 158,160.

As best shown in FIG. 2, the dash-pot assembly 54 is positioned within a cavity comprising connected counterbores 162,164 in the insulator base 52 and spacer 56 respectively. The cavity is closed at its front end by mounting plate 50 and at its back end by a central web 166 having a central opening 168 for shaft 40. Thus, the dash-pot assembly passes through insulating base 52 and partly through insulator spacer 56.

The dash-pot assembly comprises a cylindrical shell 170, a back wall 172, a front cover 174 held by a circular spring clip 176, and a peripheral O-ring seal 178. The shaft 40 passes through central openings in the back wall 172 and the front cover 174 where leakage is prevented by shaft seals 180 and 182. A piston 184 is secured to the shaft by a roll pin or rivet 186. Air flow past the piston is blocked by O-ring seals 188 and 190. Air is allowed to flow between front and back sections of the cylinder only through a tiny air passage 192 (#80 drill size) through the piston wall.

As the shaft and piston move in either direction, a difference in air pressure is generated to slow movement of the shaft and the moveable contact member 60 carried by it. Pressure eventually equalizes as air flows through the air passage 192.

The first stationary contact member 58 is the power contacting member and comprises a disk of electrical insulating material. It is secured to the back side of spacer 56 by bolts 194, one of which is shown in FIG. 3. It has a central bore 196 through which the shaft is moveable and a central cavity 198 on the front side receiving a circular protrusion 200 on the spacer 56.

The first stationary power contact member 58 supports power contact means and the terminal means therefor. In the embodiment illustrated, this comprises six power contacts including three input power contacts **202*a*, 202*b*, and 202*c*, and three output power contacts 204*a*, 204*b*, and 204*c*. The contacts in this case are illustrated as socket contacts. The input power contacts have terminals 206 to provide connections to leads L-1, L-2, and L-3 of a three-phase electrical power source. The output power contacts have terminals 208 to provide connections through leads LD-1, LD-2, and LD-3 to the three-phase induction motor M (FIG. 21**).

The moveable contact member 60 comprises a disk 207 of electrical insulating material. It is mounted on the rear end of the shaft 40 by a cap screw 208 and washers 210 for forward and backward axial movement therewith. It has a circular array of six twin contact assemblies **220*a*, 220*b*, 220*c*, 222*a*, 222*b*, and 222*c*. These six twin contact assemblies are substantially the same except that 220*b* and 222*b* have longer mid-sections surrounded by insulating sleeves 228. Each includes oppositely facing contacts in back-to-back electrically conductive relation. Each of the six twin contact assemblies has a front power pin contact 216 engageable with a corresponding input or output power socket contact on member 58, and a back grounding pin contact 218 engageable with a corresponding grounding socket contact (to be described) on member 64**.

Figure 16:
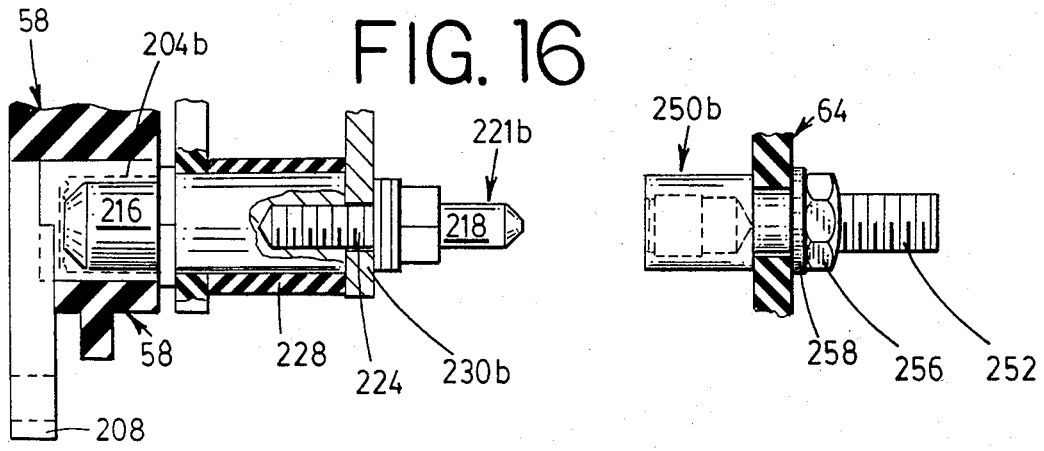
FIG. 16 is an enlarged view of one set of power and grounding contacts showing them in the "closed" position corresponding to FIG. 13.

Twin contact assemblies **220*b* and 222*b* are structurally identical, having a screw-threaded interconnection 224 between the pins 216 and 218 (FIG. 2). Twin contact assemblies 220*a*, 220*c*, 222*a*, and 222*c* are structurally identical, having a screw-threaded interconnection 226 between the pins 216 and 218 (FIG. 2). Assembly 222*b* is shown enlarged in FIGS. 16, 17, and 18**.

For purposes of this description and for consistency with the claim terminology, these six moveable twin contact assemblies may be regarded as two sets of three twin contact assemblies as follows: a first set **220*a*, 220*b*, and 220*c*; and a second set 222*a*, 222*b*, and 222*c*. These are the upper and lower three twin contact assemblies respectively in FIGS. 3, 4, 19, and 20**.

Corresponding twin contact assemblies in the two sets (**220*a*, 220*b*, and 220*c* on the one hand, and 222*a*, 222*b*, and 222*c* on the other hand) are connected in pairs by bus conductor means as follows. As best shown in FIGS. 2, 4, 19, and 20, twin contact assemblies 220*a* and 222*a* are connected by a bus conductor 230*a*, and twin contact assemblies 220*c* and 222*c* are connected by a similar bus conductor 230*c*; and twin contact assemblies 220*b* and 222*b* are connected by bus conductor 230*b*. The twin contact assemblies are secured to the bus conductors by washers 234 as shown in FIGS. 2, 4 and 16–18**.

As best shown in FIGS. 2 and 4, a rearwardly extending switch actuating plunger 236 of electrical insulating material is threadedly engaged in a center, screw-threaded opening 238 in the long center bus conductor **230*b*.**

The apertured insulator cage 62 is secured fore and aft to the stationary contact members 58 and 64 by tie bolts 242. It surrounds and encloses the moveable contact member 60 and has openings 244 through which the position of the moveable contact member can be visually monitored through window 38.

The second stationary contact member 64 is a grounding contact member and comprises a disk 246 of electrical insulating material. As stated, it is secured to the rear end of the switch assembly by tie bolts 242. It supports grounding contact means and terminal means therefor. In the embodiment illustrated, this comprises six equally circumferentially spaced grounding socket contacts including a first set of three contacts **248*a*, 248*b*, and 248*c* and a second set of three contacts 250*a*, 250*b*, and 250*c*. Each has a back, threaded portion 252 (FIG. 2) extending through a hole 254 in the insulating disk and is held in place by a nut 256 and washers 258. A switch 260 is positioned on the back side of the disk 246 and has an actuation shaft 262 on the front side engageable with plunger 236. Adjusting nuts 264,264 position the switch 260 for actuation when the shaft 40 is moved to or near the open, load-grounded position, for the purpose of coordinating it with the operation of other, possibly remote, control and monitoring gear. This switch 260 is generally used for indication but also may be used as part of the control scheme. As best shown in FIGS. 2, 5, 19, and 20, the first set of grounding contacts 248*a*, 248*b*, and 248*c* are interconnected by copper busses 266,268 and are connected via a heavy grounding wire 270 to ground. As shown in FIG. 2, a control wire support 272 is mounted on the back side of disk 246**.

As best shown in FIGS. 19 and 20, wire jumpers **274*a*, 274*b*, and 274*c* are connected between the corresponding output power contacts 204***a*, 204*b*, and 204*c* to grounding contacts 250*a*, 250*b*, and 250*c* on the stationary contact member 64. The copper busses 266 and 268 interconnect the three phases of the inputs on the rear side of the insulator disk 64, to maintain equal electrical potential of the phases with respect to ground.

The stationary insulator base 52 has four, equally circumferentially spaced peripheral recesses 276 which can accept microswitches 278. They can be used for electrical interlocking between the isolation switch and motor contactors or circuit breakers to protect the isolation switch from being operated under load, or for indication of whether the switch is open or closed. Each microswitch 278 is actuated by a plunger 280 when the isolation switch is moved into the closed position. The plungers are mounted through stationary insulator base 52 and spacer 56, protruding rearwardly from the latter. Spring 282 compressionally biases the plunger rearwardly. Forward movement of the moveable member 60 to close the isolation switch actuates the microswitch via the plunger just prior to full engagement of the input and output power contacts, which is just prior to establishing a stable position of the handle on the left hand side as shown in FIG. 15. Conversely, rearward movement of moveable member 60 releases plunger 280 from the corresponding microswitch just after the handle is moved from its stable position on the left hand side when the switch is being opened.

Use and operation of the isolation switch is believed to be apparent from the foregoing description. It is not intended to make or break under operating loads. As a preliminary to operating it, the main circuit breaker 30 will always be opened. Briefly, when the handle sleeve 68 is pulled radially outwardly, this releases the latch bar tooth 70*a* or 70*b* from the corresponding detent flange 122*a* or 122*b*.

For example, assume the handle assembly is swung to the right as shown in FIG. 13. It is locked in this position by engagement of detent tooth 70*b* with detent flange 122*b*. The shaft 40 and moveable contact member 60 are at their most rearward positions. This is the "open, load-grounded" position best shown in FIGS. 18 and 19 at which the power input leads L-1, L-2, and L-3 are completely disconnected from the motor M. Grounding pins 218 on the back sides of twin contact assemblies 220*a*, 220*b*, 220*c*, 222*a*, 222*b*, and 222*c*, respectively, are seated in stationary grounding sockets 248*a*, 248*b*, 248*c*, 250*a*, 250*b*, and 250*c*, respectively. The motor leads LD-1, LD-2, and LD-3 are connected to each other and to ground via jumpers 274*a*, 274*b*, and 274*c*, bus conductors 230*a*, 230*b*, and 230*c* and copper busses 266 and 268. A green safety light (not shown) may be actuated by switch 260 to indicate a safe circuitry. As a further confirmation, the electrician can look through window 38 and verify the position of the moveable contact member 60. A padlock may then be placed through holes 140, 144 in the extended operator guide plate 44 and handle assembly 36 to assure that it remains safe while the electrician works on the motor or associated wiring or control equipment.

Figure 17:
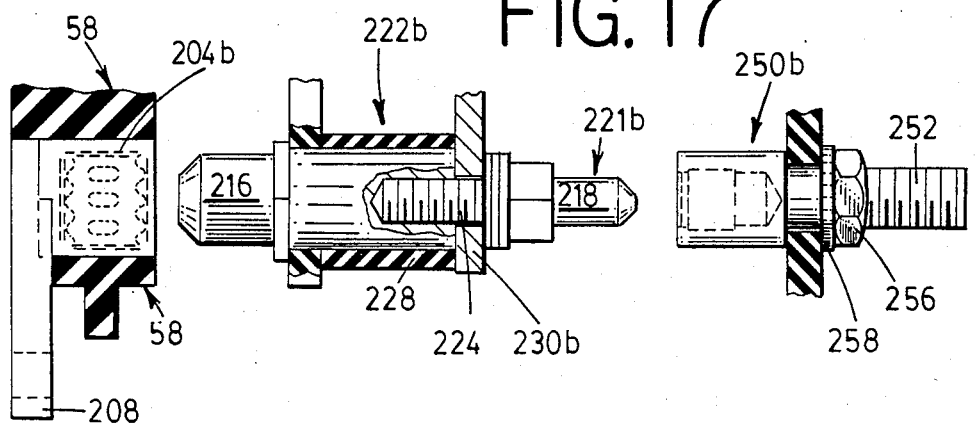
FIG. 17 is a view similar to FIG. 16 showing the contacts in intermediate position corresponding to FIG. 14.
Figure 18:
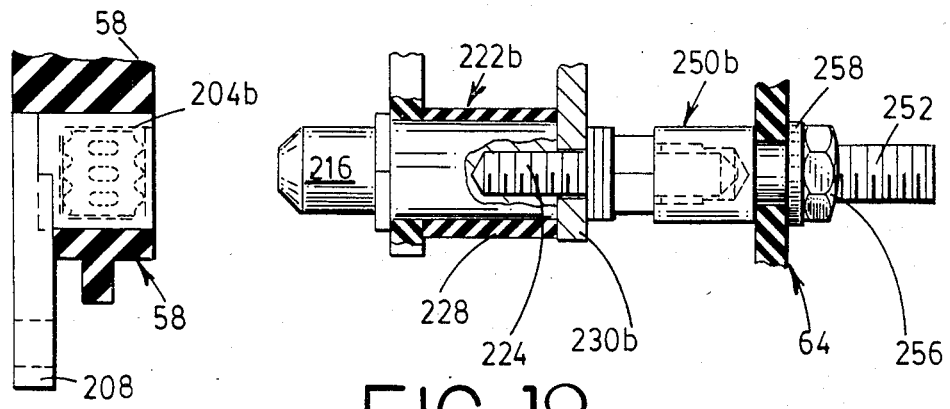
FIG. 18 is a view similar to FIG. 16 showing the contacts in "open, load-grounded" positions corresponding to FIG. 15.

To close the switch from the FIG. 13 position, the handle sleeve 68 is first pulled radially to the right to release detent tooth 70*b* from detent flange 122*b*. The handle assembly is then swung to the left, first to the intermediate position shown in FIG. 14 where the cam bosses 94,94 are in their leftwise positions within the respective guide slots 126. In this intermediate position, the power contacts 216 are opened, but the grounding contacts 218 are not yet closed, as shown in FIG. 17.

Continued leftwise swinging movement of the handle assembly from the FIG. 14 position causes the cam bosses 94 to move to the right within the guide slot 126 while the shaft 40 is fully forward as shown in FIG. 15. This is the "closed" position shown in FIGS. 18 and 20 where the motor M is connected to the circuit breaker leads L-1, L-2, and L-3 via bus conductors 230*a*, 230*b*, and 230*c* and leads LD-1, LD-2, and LD-3.

While the specific form of isolation switch described and shown constitutes a preferred embodiment of the invention, it should be understood that the invention is not limited to this precise form, and changes may be made without departing from the spirit and scope of the invention.

The embodiments of the invention in which an exclusive property or privilege is claimed are defined as follows:

1. An isolation switch for use in hazardous atmospheres comprising:

a mounting member having a hub;

an operating shaft journaled for axial movement in a bore in said hub;

said bore having sufficient axial length and minimal clearance relative to the shaft to provide a flame-resistant passage therebetween;

first and second stationary members supported in spaced-apart relation on said mounting member;

said first stationary member having separate input and output power contact means and terminal means therefor;

said second stationary member having grounding contact means and grounding terminal means therefor;

a moveable member supported on said shaft and moveable with the shaft between closed and open, load-grounded positions;

electrically conductive means on the moveable member for connecting the output power contact means to the input power contact means in response to movement of the moveable member to the closed position;

further electrically conductive means on the moveable member for disconnecting the outputpower contact means from the input power contact means, and for connecting the outputpower contact means to the grounding contact means in response to movement of the moveable member to the open, load-grounded position;

external handle means pivotally supported on said shaft;

handle guide means, handle cam means, and handle latch means acting between said handle means and said hub;

said handle guide means being effective to guide said handle means for swinging movement between closed and open positions corresponding to said closed and open, load-grounded positions of the moveable member;

said handle cam means being effective to move said shaft and moveable member between closed and open, load-grounded positions; and said handle latch means being selectively effective to hold said handle means in closed or open positions.

2. An isolation switch according to claim 1 in which:

said grounding contact means comprises first and second sets of grounding contacts on said second stationary member;

means connecting one set to said grounding terminal means; and means connecting the other set to said output power contact means.

3. An isolation switch according to claim 2 in which said means connecting the other set of grounding contact means to said output power contact means comprises separate jumpers connecting corresponding contacts in said second set and in said output power contact means.

4. An isolation switch according to claim 1 in which:

said input power contact means comprises a number of individual contacts;

said output power contact means comprises the same number of individual contacts;

said electrically conductive means on the moveable member comprises twice said number of individual contacts and are positioned to engage said individual input and output power contacts when the moveable member is in said closed position; and bus conductors connecting the contacts on the moveable member in pairs to thereby interconnect corresponding contacts in said input and output power contact means when the moveable member is in the closed position.

5. An isolation switch according to claim 1 in which:

said grounding contact means comprises first and second sets of individual grounding contacts on said second stationary member;

said first set of contacts are connected to said grounding terminal means;

said output power contact means comprises a third set of individual contacts;

said three sets of contacts comprise corresponding numbers of individual contacts;

separate jumpers connect corresponding contacts in said output power contact means and in said second set of grounding contacts;

said further electrically conductive means on the moveable member include individual contacts corresponding to all the contacts in said first and second set of grounding contacts and are positioned to engage same when the moveable member is in the open, load-grounded position; and bus conductors on the moveable member connecting the first and second sets of grounding contacts in paris to thereby interconnect corresponding contacts in said first and second sets of grounding contacts when the moveable member is in the open, load-grounded position.

6. An isolation switch according to claim 5 in which each contact on the moveable member is part of a twin-contact sub-assembly having two opposite contact portions connected back-to-back in which one contact portion engages a corresponding contact on the first stationary member when the moveable member is in closed positionand the other contact portion engages a corresponding contact on the second stationary member when the moveable member is in the open, load-grounded position.

7. An isolation switch according to claim 5 in which the bus conductors are common to said electrically conductive means and to said further electrically conductive means on the moveable member.

8. An isolation switch according to claim 1 in which:

said first and second stationary members and said moveable member are discs of electrical insulating material centrally located along the axis of said shaft;

said moveable member is positioned between the stationary members;

said input and output power contact means comprises a circular array of contacts concentric with said axis and consists of a first set of input power contacts and a second set of output power contacts;

said grounding contact means comprises a circular array of contacts concentric with said axis and consists of first and second sets of grounding contacts, the first set being connected to said grounding terminal;

said electrically conductive and said further electrically conductive means on the moveable member including a circular array of twin contacts concentric with said axis, each such twin contact having two opposite contact portions connected back-to-back and facing oppositely toward the first and second stationary members, said twin contacts being grouped in first and second sets thereof;

said first and second sets of contacts on the three members being aligned parallel to said axis;

jumper means interconnecting corresponding ones of the second sets of contacts on said first and second stationary members;

bus conductors on the moveable member interconnecting each twin contact in said first set thereof with the corresponding twin contact in said second set thereof to thereby interconect corresponding contacts in said input and output power contacts when the moveable member is in the closed position, and to thereby further interconnect corresponding grounding contacts in the first and second sets of grounding contacts when the moveable member is in the open, load-grounded position.

9. An isolation switch according to claim 8 in which said first and second stationary members are secured to a cylindrical cage enclosing said moveable member and said cage is provided with apertures for visually monitoring the position of said moveable member through a window in said enclosure.

10. An isolation switch according to claim 8 in which said contacts on the first and second stationary members are socket contacts, and said twin contacts on the moveable member are oppositely facing pin contacts engageable with corresponding ones of said socket contacts.

11. An isolation switch according to claim 8 in which each set of contacts comprises three contacts.

12. An isolation switch according to claim 1 in which the input and output power contact means and the grounding contact means are socket contacts, and the electrically conductive means on the moveable member include pin contacts engageable with corresponding ones of said socket contacts.

13. An isolation switch according to claim 1 in which:

the input and output power contact means on the first stationary member comprises six socket contacts;

the grounding contact means on the second stationary member comprises six socket contacts;

the electrically conductive means on the moveable member includes one set of six pin contacts on one side thereof engageable with corresponding socket contacts on the first stationary member;

the further electrically conductive means on the moveable member includes a second set of six pin contacts on the opposite side thereof engageable with corresponding socket contacts on the second stationary member; and said first and second sets of six pin contacts comprise six back-to-back connected pairs of pin contacts facing in opposite directions.

14. An isolation switch according to claim 1 including auxiliary control switch means and switch actuator means therefor comprising relatively moveable elements, one of which is connected for movement with the shaft and the other of which is mounted on a stationary part of the isolation switch.

15. An isolation switch according to claim 1 in which dash-pot means is interposed between a stationary part of the isolation switch and the shaft to limit the speed of movement of the shaft.

16. An isolation switch for use in hazardous atmospheres comprising:

a hub supported on one wall of an enclosure;

an operating shaft journaled for axial movement in a bore in said hub;

said bore having sufficient axial length and minimal clearance relative to the shaft to provide a flame-resistance passage therebetween;

input power contact means, output power contact means, grounding contact means, and separate terminal means for the respective contact means;

means for connecting the input and outputpower contact means in response to movement of said shaft to a closed position;

means for disconnecting the output power contact means from the input power contact means and for connecting the output power contact means to the grounding contact means in response to movement of said shaft to an open, load-grounded position;

external handle assembly means connected to the shaft externally of the hub;

operator latch guide means secured to the hub restricting said handle assembly means to swinging movement in a plane normal to said one wall of an enclosure, said handle assembly means being swingable between opposite positions corresponding to said closed and to said open, load-grounded positions of said shaft;

and latch means acting between said operator latch guide means and said handle assembly means for holding said handle assembly means in either of said opposite positions.

17. An isolation switch according to claim 16 in which:

said operator latch guide means is secured to said hub and has a bore aligned with the bore in the hub in axial guided relationship with the shaft, a pair of diametrically opposed tongues extending outwardly from the hub and flanking said shaft, said tongues having flat outer side surfaces parallel to the shaft;

said handle assembly means comprises a bifurcated cam and lever member and a manually manipulatable handle sleeve moveably mounted thereon;

said bifurcated cam and lever member has a pair of transversely spaced, flat, parallel lever arms in close guided relationship with said flat outer side surfaces on the operator latch guide means, a pair of cam bosses on said lever arms, and a pivotal connection between the shaft and eccentric locations on the lever arms; and a pair of operator guide plates extending outwardly along said lever arms and having guide slots elongated in a direction transverse to the shaft with said cam bosses being guided for movement in said slots;

whereby said shaft is axially moveable in response to swinging movement of said handle assembly means.

18. An isolation switch according to claim 17 in which said latch means includes:

oppositely extending detent flanges on said tongues;

a latch bar connected to the handle sleeve for movement therewith toward and away from the operator latch guide means; and a pair of detent teeth on said latch bar being alternately engageable with said detent flanges to hold said handle assembly means selectively in one or the other of its said opposite positions.

19. An isolation switch according to claim 17 in which said latch means includes:

oppositely outwardly extending detent flanges on said tongues;

a plunger journaled for axial movement in said cam and lever member and being connected for movement with said handle sleeve;

a latch bar connected transversely across one end of said plunger;

a pair of detent teeth at opposite ends of said latch bar being alternately engageable with said detent flanges to hold said handle assembly means selectively in one or the other of its said opposite positions.

20. An isolation switch according to claim 19 having spring means within the cam and lever member biasing said latch bar in a direction to automatically engage either of said detent teeth with a corresponding detent flange in response to swinging said handle assembly means to one or the other of its said opposite positions.

21. An isolation switch according to claim 19 in which:

said latch bar is offset asymmetrically across the end of said plunger; and said detent flanges are at different axial positions along the shaft corresponding to the offset position of the latch bar.

22. An isolation switch according to claim 19 in which:

the detent teeth on the latch bar are offset asymmetrically from the axis of the plunger; and the detent flanges are at different axial positions along the axis of the shaft corresponding to the offset positions of the detent teeth.

23. An isolation switch according to claim 22 in which the tongues are different lengths corresponding to the different axial positions of the detent flanges.

* * * * *

UNITED STATES PATENT AND TRADEMARK OFFICE

CERTIFICATE OF CORRECTION

PATENT NO. : 4,737,603

DATED : April 12, 1988

INVENTOR(S) : Jennings Lycan

It is certified that error appears in the above-identified patent and that said Letters Patent is hereby corrected as shown below:

Col. 1, line 39 "feed" -- should read "feet";

Col. 1, line 63, "quenches" -- should read "quenched";

Col. 10, line 46 "outputpower" -- should read "output power";

Col. 10, line 48, "outputpower" -- should read "output power";

Col. 11, line 50, "paris" -- should read "pairs";

Col. 11, line 60, "positionand" -- should read "position and";

Col. 13, line 28, "outputpower" -- should read "output power".

Signed and Sealed this

Fourth Day of October, 1988

*Attest:*

DONALD J. QUIGG

*Attesting Officer*

*Commissioner of Patents and Trademarks*